US007641710B2

(12) United States Patent
Engström et al.

(10) Patent No.: US 7,641,710 B2
(45) Date of Patent: Jan. 5, 2010

(54) TOOL FOR COLDFORMING OPERATIONS WITH IMPROVED PERFORMANCE

(75) Inventors: Håkan Engström, Bromma (SE); Luis Miñarro i Bruguera, Barcelona (ES); Vasco i Salas, Barcelona (ES)

(73) Assignee: Sandvik Intellectual Property AB, Sandviken (SE)

( * ) Notice: Subject to any disclaimer, the term of this patent is extended or adjusted under 35 U.S.C. 154(b) by 102 days.

(21) Appl. No.: 11/440,435

(22) Filed: May 25, 2006

(65) Prior Publication Data

US 2006/0272449 A1 Dec. 7, 2006

(30) Foreign Application Priority Data

May 27, 2005 (SE) ..... 0501201
Oct. 17, 2005 (SE) ..... 0502290

(51) Int. Cl.
*C22C 29/08* (2006.01)
*B21K 5/20* (2006.01)

(52) U.S. Cl. ..... 75/240; 76/107.4

(58) Field of Classification Search ..... 75/240; 76/107.4

See application file for complete search history.

(56) References Cited

U.S. PATENT DOCUMENTS 2,133,867 A * 10/1938 Lucas ..... 75/242
3,514,818 A 6/1970 Meadows
4,148,208 A 4/1979 Maeder
4,820,482 A 4/1989 Fischer et al.
5,009,705 A 4/1991 Yoshimura et al.
5,095,730 A 3/1992 Lauder
5,396,788 A 3/1995 Dziedzic et al.
5,736,658 A 4/1998 Mirchandani et al.
5,773,735 A * 6/1998 Dubensky et al. ..... 75/240
5,882,376 A 3/1999 Kim et al.
5,918,102 A 6/1999 Friederichs
5,948,523 A 9/1999 Carpenter et al.
6,086,650 A 7/2000 Carpenter
6,402,802 B1 * 6/2002 Bhagat ..... 75/240
6,464,748 B2 10/2002 Perez et al.
6,793,875 B1 * 9/2004 Shaw et al. ..... 419/18
2002/0031440 A1 3/2002 Grearson et al.
2002/0059849 A1 5/2002 Perez et al.
2004/0149362 A1 * 8/2004 Kusinski et al. ..... 148/650
2005/0129951 A1 * 6/2005 Collin et al. ..... 428/408
2006/0272448 A1 12/2006 Engstrom et al.

FOREIGN PATENT DOCUMENTS

JP 4-128330 * 4/1992

OTHER PUBLICATIONS

A.M. Massai et al. "Scientific and technological process in the filed of steel wire drawing." *Wire*. Jun. 1999, pp. 36-40.
U.S. Appl. No. 12/003,202 entitled Corrosion Resistant Tool by Emmanuel Pauty et al., filed Dec. 20, 2007 (available electronically).

* cited by examiner

*Primary Examiner*—Roy King
*Assistant Examiner*—Ngoclan T Mai
(74) *Attorney, Agent, or Firm*—Drinker Biddle & Reath LLP

(57) ABSTRACT

The present invention relates to cemented carbide for steel tire cord drawing operations. The cemented carbide comprises WC with an ultra fine grain size and greater than 5 and less than 10 wt-% Co, including grain growth inhibitors (V and/or Cr) and with a specific relation between HV30 and cobalt content.

2 Claims, 1 Drawing Sheet

TOOL FOR COLDFORMING OPERATIONS WITH IMPROVED PERFORMANCE

BACKGROUND OF THE INVENTION

The present invention relates to a tool for coldforming and drawing operations, particularly steel tire cord drawing operations.

The performance of a drawing die in production of steel tire cord is improved by increasing the hardness of the cemented carbide. Coarse wire is usually dry drawn by grades with 10 wt-% or 6 wt-% Co and a hardness 1600 and 1750 Vickers respectively. Wet drawing from 1.5-2 mm down to final dimension, 0.15-0.3 mm, is usually made with drawing dies in grades having a hardness of from about 1900-2000 HV and Co binder content <5 wt-%, most often around 3 wt-%.

In the 1980's a grade having only 3 wt-% binder and ultra fine grain size for tire cord drawing was introduced by Sandvik. It was later withdrawn due to the low strength and brittle behaviour leading to premature failures.

In a European project, Wireman, (reported by A. M. Massai et al, "Scientific and technological progress in the field of steel wire drawing", Wire 6/1999), the conditions for drawing of tire cord were investigated. New cemented carbide grades were tested in the grain size range of 0.3-1 μm and a binder content of 0.3-5 wt-%. A hardness increase was achieved by reducing the binder content and decreasing the grain size of WC. According to published results, the grades did not completely satisfy the expectation on better performance, despite the high hardness achieved. The conclusion quotes: "The wear tests demonstrated that not only the hardness of the dies controls the die wear mechanism."

According to U.S. Pat. No. 6,464,748, beside hardness of cemented carbide, corrosion is a major factor controlling the wear resistance. Normally higher Co binder content leads to higher sensitivity to corrosion and said US-patent discloses improvements by low binder content and alloying of the cobalt binder with nickel and chromium to make it corrosion resistant, i.e. a similar approach as in the above mentioned Wireman project.

U.S. Pat. No. 5,948,523 discloses a coldforming tool with an improved hard wearing surface zone. This has been achieved by a post-sintering heat treatment in a boron nitride containing environment of a hard metal of a suitable composition. The effect is most pronounced when the heat treatment is made of a hard metal which has previously been sintered to achieve a high carbon content through a suitable choice of chemical composition and processing conditions.

During many years there has been an ongoing development of cemented carbide with finer and finer grain size.

The extension of cemented carbide grain sizes into the ultra fine size range leads to a number of positive improvements regarding the wear processes.

Attrition wear (or grain loss volume) may be reduced by an order of magnitude by little more than halving the sintered grain size (in the absence of other wear processes), since grain volume is related to the cube of diameter.

Adhesive fracture is another dangerous kind of attrition wear, in which the separation of strongly welded tool-work-material interfaces can induce tensile cleavage within the underlying carbide. Ultra fine hardmetals can resist the onset of such fractures better than coarser ones due to their greater rupture strength.

Erosion/corrosion of the binder phase is said to be part of the wear mechanism in wire drawing. Even though the content of binder is increased in ultra fine cemented carbide the smaller WC grain size leads to thinner binder films, generally called binder free path. Thus resistance to selective erosion of the soft binderphase by wear particles is reduced. It is reasonable to believe that the thinner binder also leads to better oxidation/corrosion properties since the properties of the binder at the WC interface is different from the pure metal.

From the above it seems that the main interest in developing finer sub-micron hardmetal, perhaps into the nanometer range, is to raise hardness, maximise attrition wear resistance and strength whilst as far as possible maintaining all other attributes at useful levels.

It has now been found that use of ultra fine grained cemented carbide with a Co content >5 wt-% can lead to improved performance in steel tire cord production by the combination of the improvements in strength, hardness and toughness of ultra fine cemented carbide.

OBJECTS AND SUMMARY OF THE INVENTION

It is an object of the present invention to provide a tool for coldforming and drawing operations particularly tire cord drawing operations with a further improved combination of high wear resistance, high strength and keeping a good toughness.

In one aspect of the invention there is provided a method of drawing steel tire cord including drawing said cord through a die, the improvement using as the die an ultra fine cemented carbide comprising WC, a binder phase of Co, and from less than about 1 wt-% grain growth inhibitors V and/or Cr, wherein the Co content is greater than about 5 but less than about 10 wt-% and a Vickers hardness, HV30>2150-52*wt-% Co.

In another aspect of the invention there is provided a drawing die comprising ultra fine cemented carbide comprising WC, a binder phase of Co, and from less than about 1 wt-% grain growth inhibitors V and/or Cr, wherein the Co content is greater than about 5 but less than about 10 wt-% and a Vickers hardness, HV30>2150-52*wt-% Co.

DETAILED DESCRIPTION OF THE PREFERRED EMBODIMENTS

Figure 1:
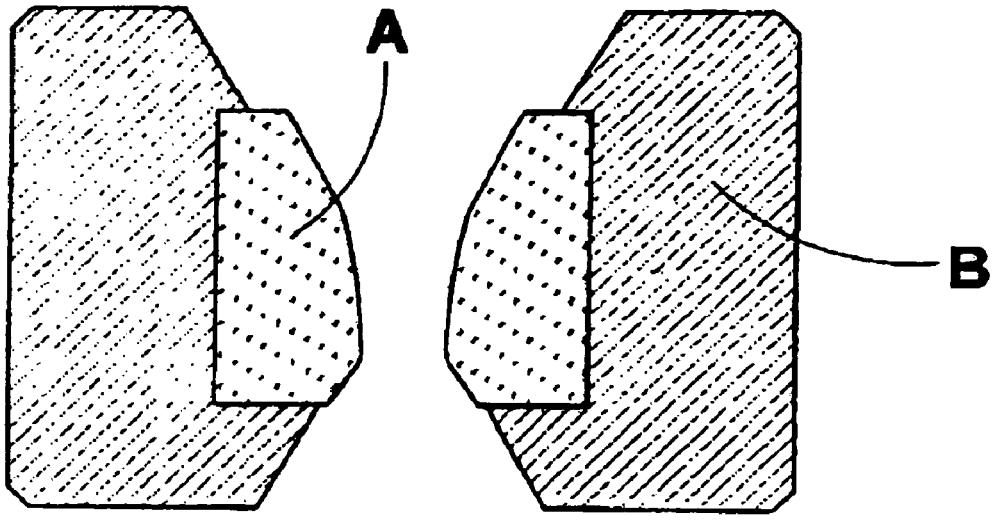
FIG. 1 shows a drawing die in which A=cemented carbide nib and B=steel casing.
Figure 2:
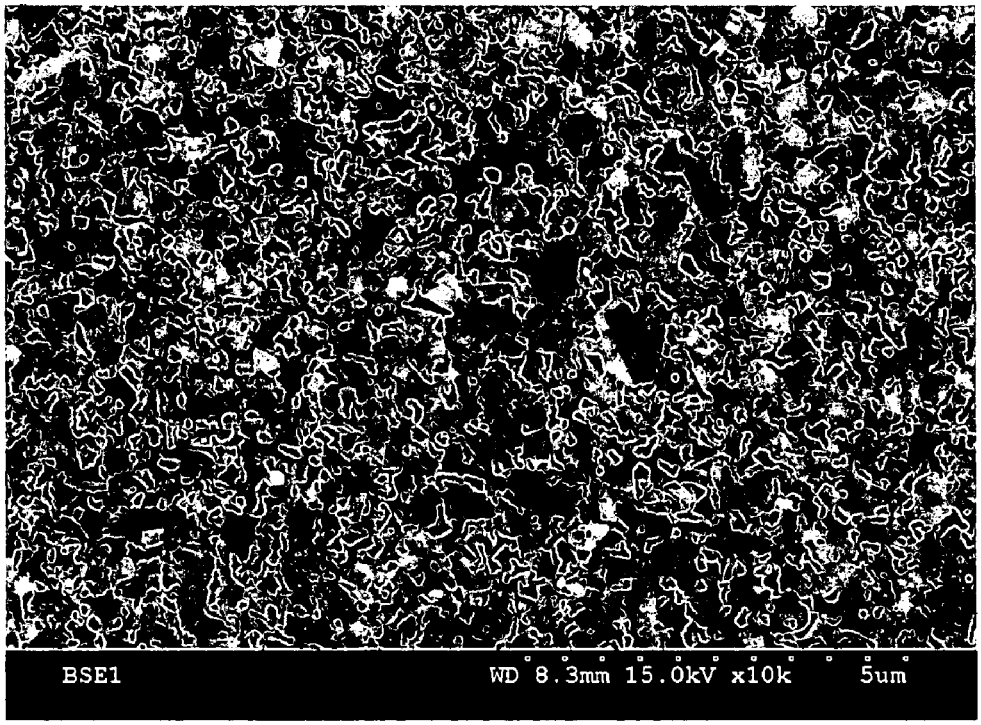
FIG. 2 shows in 10000 times magnification the microstructure of a cemented carbide according to the present invention etched in Murakami. The structure contains WC and Co binder.

It has now surprisingly been found that a tool for coldforming and drawing operations, particularly tire cord drawing operations with a better performance than prior art tools can be obtained if the tool is made of a cemented carbide with a Co content greater than about 5 wt-% but less than about 10 wt-% comprising WC with an ultra fine grain size. A combination of grain size and binder content that leads to better performance is represented by from about 6 wt-% Co with ultra fine WC having a hardness to about 100-150 HV higher than most used 3 wt-% Co binder grade having hardness of 1925 HV.

Another example of ultra fine cemented carbide successfully tested for tire cord drawing is characterized by having from about 9 wt-% of cobalt and ultra fine tungsten carbide grain size so that the hardness, HV30, is 1900. Thus the same hardness level as the conventional 3 wt-% binder grade is achieved by the ultra fine grain size.

Improved wear resistance is achieved by decreasing the grain size and increasing the binder content so that the hardness as HV30 is maintained or even increased by having an ultra fine grain size of tungsten carbide.

Thus the invention relates to the use as a cold forming tool of cemented carbide grades with increased Co binder content and very much decreased WC grain size, producing material with improved wear resistance for coldforming and drawing operations particularly tire cord drawing operations.

It is a well known fact that hardness of cemented carbide is dependent on the binder content and tungsten carbide grain size. Generally as grain size or binder content decreases the hardness increases. In order to circumvent the well known difficulties in defining and measuring "grain size" in cemented carbide, and in this case to characterize "ultra fine cemented carbide", a Hardness/Binder content relation is used to characterize the cemented carbide according to the present invention.

The invention thus relates to a cold forming tool of cemented carbide having a binder content from greater than about 5 to less than about 10 wt-% and a hardness with the following relation between HV30 and Co-content in wt-%:

$$HV30>2150-52*wt\text{-}\%\ Co$$

preferably $$HV30>2200-52*wt\text{-}\%\ Co$$

more preferably $$HV30>2250-52*wt\text{-}\%\ Co$$

and most preferably the hardness HV30>1900.

The cemented carbide is made by conventional powder metallurgical techniques such as milling, pressing and sintering.

The invention also applies to the use of the cemented carbide according to the invention particularly for the steel tire cord drawing operations but it can also be used for other coldforming and drawing operations such as deep drawing of cans.

The invention is additionally illustrated in connection with the following examples, which are to be considered as illustrative of the present invention. It should be understood, however, that the invention is not limited to the specific details of the examples.

EXAMPLE 1

Steel wire drawing dies with inner diameters between 1.3 and 0.2 mm and

A. WC-3 wt-% Co, submicron grain size, VC as grain growth inhibitor, prior art.

B. Ultra fine cemented carbide consisting of WC-9 wt-% Co with V and Cr carbide grain size inhibitor, invention.

The Vickers hardness HV30 of the grades is 1925 and 1950 respectively. The tools were tested in the wire drawing of brass coated steel wires of high tensile strength for tire cord applications with the following results. Performance factor relates to the quantity of product (wire) as length of mass drawn through the different nibs relative to the prior art nib, A. Table 1 summarizes the results.

TABLE 1

| Sample | Performance Factor |
|---|---|
| A. prior art | Ref |
| B. invention | +15% |

EXAMPLE 2

Steel wire-drawing dies with inner diameters between 1.3 and 0.175 mm and

A. Same prior art grade as in Example 1.

B. Ultra fine cemented carbide drawing die consisting of WC and 6 wt-% Co with grain size inhibitor V and Cr.

The Vickers hardness HV30 of the grades are 1925 and 2050 respectively, tested in drawing of brass coated steel wire for tire cord:

Table 2 summarizes the results.

TABLE 2

| Sample | Performance factor |
|---|---|
| A. prior art | Ref |
| B. invention | +30% |

EXAMPLE 3

Steel wire drawing dies with inner diameters between 1.7 and 0.3 mm and

Same composition of cemented carbide as in Example 2 was tested in the drawing of brass coated steel wire for tire cord.

TABLE 3

| Sample | Performance factor |
|---|---|
| A. prior art | Ref |
| B. invention | +120% |

It can be seen from the great differences in improvements, 15-120%, that the conditions in the wire drawing operation, e.g. steel quality, lubrication, maintenance etc, factors outside the influence of the cemented carbide manufacturer, superimpose a great variation. Thus, the tests in the examples can not be compared more than within each test conditions.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. In a method of drawing steel tire cord including drawing said cord through a die, the improvement comprising using as the die an ultra fine cemented carbide comprising WC, a binder phase of Co, and greater than zero and less than about 1 wt-% grain growth inhibitors V and/or Cr, wherein the Co content is about 6 wt-% and a Vickers hardness, HV30, is about 2050 and wherein the cemented carbide has a liquid-phase-sintered microstructure.

2. Drawing die comprising ultra fine cemented carbide comprising WC, a binder phase of Co, and greater than zero and less than about 1 wt-% grain growth inhibitors V and/or Cr, wherein the Co content is about 6 wt-% and a Vickers hardness, HV30, is about 2050 and wherein the cemented carbide has a liquid-phase-sintered microstructure.

* * * * *